US007740030B2

(12) United States Patent
Ghesquiere et al.

(10) Patent No.: US 7,740,030 B2
(45) Date of Patent: Jun. 22, 2010

(54) SELVEDGE FORMING APPARATUS, WEAVING MACHINE WITH A SELVEDGE FORMING APPARATUS AND METHOD FOR FORMING A SELVEDGE

(75) Inventors: Marnix Ghesquiere, Lauwe (BE); Jean Marie Bamelis, Ieper (BE)

(73) Assignee: Picanol N.V., Ieper (BE)

( * ) Notice: Subject to any disclaimer, the term of this patent is extended or adjusted under 35 U.S.C. 154(b) by 310 days.

(21) Appl. No.: 10/589,731

(22) PCT Filed: Mar. 3, 2005

(86) PCT No.: PCT/EP2005/002233

§ 371 (c)(1),
(2), (4) Date: May 14, 2008

(87) PCT Pub. No.: WO2005/095693

PCT Pub. Date: Oct. 13, 2005

(65) Prior Publication Data

US 2009/0025816 A1 Jan. 29, 2009

(30) Foreign Application Priority Data

Mar. 5, 2004 (BE) ..... 2004/0122
Oct. 19, 2004 (BE) ..... 2004/0514

(51) Int. Cl.
*D03D 47/48* (2006.01)
*D03D 49/50* (2006.01)

(52) U.S. Cl. ..... 139/434; 139/435.4; 139/116.2

(58) Field of Classification Search ..... 139/434, 139/194, 435.4, 116.1, 116.2, 453
See application file for complete search history.

(56) References Cited

U.S. PATENT DOCUMENTS 2,267,287 A * 12/1941 Moessinger ..... 139/434
3,845,790 A * 11/1974 Filter et al. ..... 139/194
3,951,177 A * 4/1976 Santucci ..... 139/434
4,570,683 A * 2/1986 Griffith ..... 139/194
4,715,410 A * 12/1987 Griffith ..... 139/434
4,905,740 A * 3/1990 Verclyte ..... 139/434
4,957,144 A * 9/1990 Watanabe et al. ..... 139/434
4,957,145 A * 9/1990 Verclyte et al. ..... 139/434
5,080,143 A * 1/1992 Bertsch ..... 139/434
5,649,570 A * 7/1997 Wahhoud et al. ..... 139/291 C
6,240,976 B1 * 6/2001 Satoh et al. ..... 139/434
6,289,942 B1 * 9/2001 Nakada et al. ..... 139/434

(Continued)

FOREIGN PATENT DOCUMENTS

EP 1 174 532 1/2002

(Continued)

*Primary Examiner*—Bobby H Muromoto, Jr.
(74) *Attorney, Agent, or Firm*—Bacon & Thomas, PLLC

(57) ABSTRACT

Weaving machine, method and selvedge forming apparatus for introducing into a shed an end (30A) of a weft thread (30) which has been inserted into a shed, the selvedge forming apparatus (4, 5, 6) being provided with a device (20) for introducing the end of the inserted weft thread into a subsequent shed, wherein the selvedge forming apparatus (4, 5, 6) includes a blowing device (50) having at least one blowing opening (51) which, in use, is positioned at the level of the plane of a selvedge (16, 17) of the woven fabric (2, 3), with the blowing device (50), blowing essentially toward the beat-up line (36) in a direction opposite to the direction of fabric movement.

24 Claims, 14 Drawing Sheets

U.S. PATENT DOCUMENTS

| | | | | |
|---|---|---|---|---|
| 6,321,796 | B1 * | 11/2001 | Sawada | 139/434 |
| 6,422,270 | B2 * | 7/2002 | Nakada et al. | 139/434 |
| 6,837,279 | B2 * | 1/2005 | Moerman et al. | 139/434 |
| 7,124,782 | B2 * | 10/2006 | Scorl et al. | 139/430 |
| 2002/0011275 | A1 * | 1/2002 | Satou et al. | 139/192 |
| 2002/0020457 | A1 * | 2/2002 | Yamamoto | 139/434 |
| 2002/0166599 | A1 * | 11/2002 | Weixler et al. | 139/212 |
| 2003/0000594 | A1 * | 1/2003 | Birner et al. | 139/370.1 |
| 2003/0178088 | A1 * | 9/2003 | Moerman et al. | 139/434 |
| 2003/0201026 | A1 * | 10/2003 | Schaich | 139/435.5 |
| 2005/0061383 | A1 * | 3/2005 | Scorl et al. | 139/11 |

FOREIGN PATENT DOCUMENTS

| | | |
|---|---|---|
| GB | 543398 | 2/1942 |
| WO | WO 01/86047 | 11/2001 |

* cited by examiner

SELVEDGE FORMING APPARATUS, WEAVING MACHINE WITH A SELVEDGE FORMING APPARATUS AND METHOD FOR FORMING A SELVEDGE

BACKGROUND OF THE INVENTION

A. Field of the Invention

The invention relates to a selvedge forming apparatus, a weaving machine using the selvedge forming apparatus and a method for forming a selvedge.

B. Related Art

A selvedge forming apparatus is known from WO 01186047. This selvedge forming apparatus positions an end of an inserted weft thread in a guide element of a holder which is positioned next to the shed. The end of this weft is blown into a subsequently formed shed by a device which is also positioned next to the shed. The blowing device includes at least one blowing opening for blowing the end of the weft thread into a subsequent shed. The blowing direction is parallel or at an angle with respect to the beat-up line from a position beside the woven fabric.

When weaving a fabric like a tire cord fabric in which the successive weft threads are woven at a relatively great distance from one another it may occur that the end of an inserted weft thread which is introduced in a subsequent shed is woven in an irregular form into the fabric.

It is an object of the present invention to improve a selvedge forming apparatus such that it may be used also for woven fabrics in which successive weft threads are woven in relatively great distance from one another with the advantage that the ends of the weft thread are woven regularly into the fabric.

SUMMARY OF THE INVENTION

To achieve this object, the selvedge forming apparatus comprises a device for introducing an end of an inserted weft thread into a subsequently formed shed and includes a blowing device for blowing an air-stream onto the end of the weft thread being introduced back in the shed, whereby, in use, the air-stream is essentially directed back toward the beat-up line and the blowing device is arranged in the vicinity of the plane of a selvedge of the woven fabric so that it blow air against the moving direction of the fabric.

The selvedge forming apparatus according to the invention allows that an end of a weft thread which has been introduced into a subsequent shed is blown essentially parallel to the beat-up line, with the result that this end will be woven regularly into the fabric. This is possible because the blowing device is arranged at about the level of the plane of the woven fabric, more particularly beneath or above the plane of a selvedge of the woven fabric.

According to a preferred embodiment, the blowing device can be positioned at about the level of the plane of a selvedge of the woven fabric, with the blowing device, in use, blowing along a plane which runs essentially parallel to the beat-up line and is directed essentially towards the beat-up line. This has the advantage that an end of a weft thread which has been introduced into a subsequent shed can be forced into a position at the level of the beat-up line under the influence of the blowing operation.

According to a preferred embodiment, the blowing device can be positioned in the vicinity of the beat-up line, preferably at a distance from the beat-up line of the order of magnitude of the distance between two successive weft threads. This offers the advantage that the blowing device according to the invention blows substantially only onto that end of the weft thread which has been introduced into a subsequent shed.

According to a preferred embodiment, the blowing device includes a number of blowing openings which, in use, blow along a plane which runs essentially parallel to the beat-up line and is directed essentially towards the beat-up line. It is preferable for blowing openings of this type to be positioned essentially along a line which, in use, runs essentially parallel to the beat-up line.

According to a preferred embodiment, the at least one blowing opening is arranged in a side of a hollow needle which, in use, can be positioned essentially parallel to the beat-up line. It is preferable for a needle of this type to include a number of blowing openings, preferably three or four blowing openings, which open out on an axially oriented line over the periphery of the hollow needle. A needle of this type is preferably positioned in the vicinity of a selvedge of the woven fabric, beneath the woven fabric formed.

According to one embodiment, the selvedge forming apparatus includes a holder and the hollow needle is secured to the holder of the selvedge forming apparatus. This enables the hollow needle to be displaced together with the selvedge forming apparatus.

To this end, the weaving machine according to the invention includes a selvedge forming apparatus which includes a blowing device having at least one blowing opening that can be positioned at about the level of the plane of a selvedge of the woven fabric, with the blowing device, in use, blowing essentially towards the beat-up line.

It is preferable to position the blowing device in the vicinity of the beat-up line. The blowing device, in use, will blow along a plane which runs essentially parallel to the beat-up line and is directed essentially towards the beat-up line in the direction of the shed.

According to a preferred embodiment, the weaving machine is an air jet weaving machine provided with a reed having blades which are profiled in an U-shape and form an air-guiding channel, and the blowing device, during the beating-up of a weft thread, is located essentially in the U-shaped portion of the profiled blades.

According to a preferred embodiment, the blowing device includes a hollow needle which, in use, can be positioned essentially parallel to the beat-up line. In this case, the blowing device, more particularly the hollow needle, can be secured to a fabric support, to the selvedge forming apparatus or to a component of the weaving machine.

According to a preferred embodiment, the blowing device is positioned beneath the woven fabric which is formed. In this case, the blowing device blows upward and essentially in the direction towards the beat-up line into the shed.

The invention also relates to a method which makes use of a selvedge forming apparatus according to the invention which includes a blowing device which can be positioned at about the level of the plane of a selvedge of the woven fabric and, in use, blows essentially towards the beat-up line, the method including the step of blowing onto the end of a weft thread for introducing this end into a shed after the weft thread was inserted into the pervious shed.

According to one embodiment, the method includes the step of blowing by using an abovementioned blowing device while the end of the weft thread is being introduced or blown into a subsequent shed. This is advantageous as this end of a weft thread introduced in the subsequent shed will be woven in a regular arrangement.

DESCRIPTION OF THE DRAWINGS

Further features and advantages of the invention will become apparent from the explanation of the invention with reference to the drawings.

DETAILED DESCRIPTION OF PREFERRED EMBODIMENTS OF THE INVENTION

Figure 1:
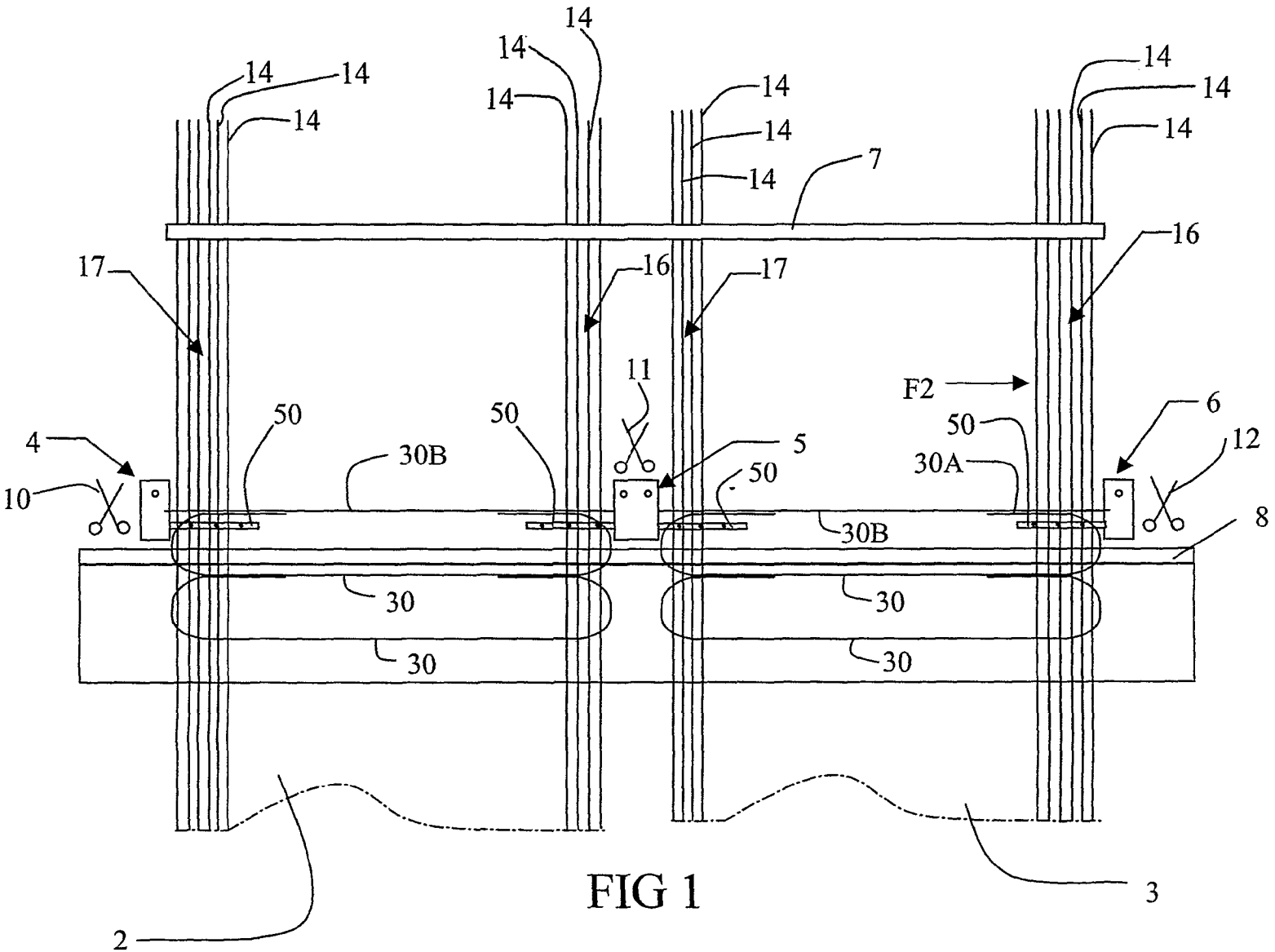
FIG. 1 diagrammatically shows a weaving machine provided with a plurality of selvedge forming apparatuses according to the invention.
Figure 2:
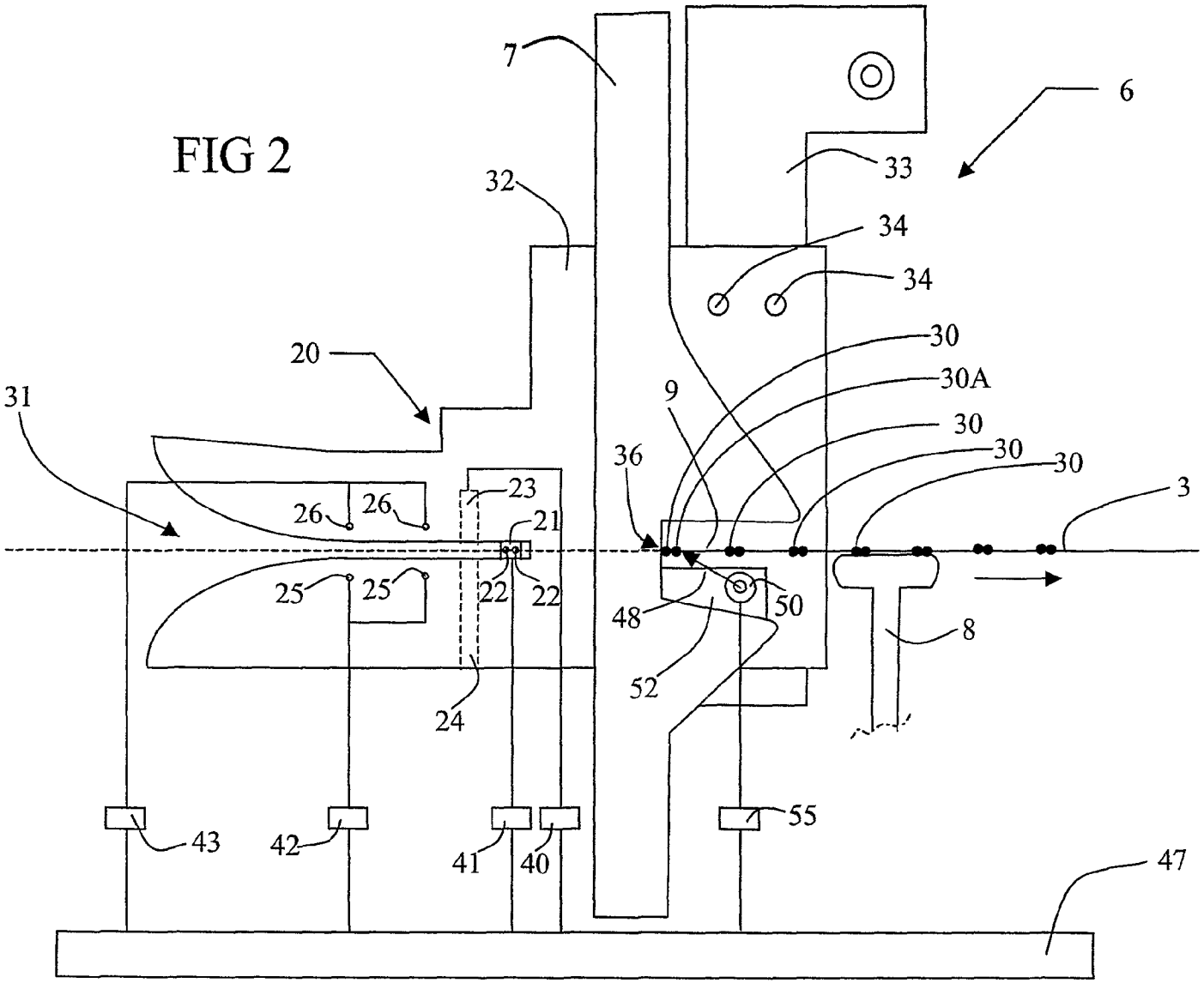
FIG. 2 shows in an enlarged scale a view in the direction of arrow F2 in FIG. 1 of a selvedge forming apparatus.

FIG. 1 diagrammatically depicts a weaving machine in which two fabrics 2 and 3 are being woven next to one another. This weaving machine includes a plurality of selvedge forming apparatuses 4, 5 and 6 according to the invention. The selvedge forming apparatuses 4, 5 and 6 are made from suitably wear-resistant material or are provided with wear-resistant inserts in a known way. Weft scissors 10, 11 or 12 are provided at each selvedge forming apparatus 4, 5 and 6, for the purpose of cutting a weft thread that has been inserted before, the ends of this weft thread that are introduced, i.e., tucked into a subsequent shed by means of the selvedge forming apparatuses 4, 5 and 6. FIG. 1 also illustrates warp threads 14, which may form sheds in a known way, and a fabric support 8. The weaving machine illustrated in FIGS. 1 and 2 is an air jet weaving machine which is provided with a reed 7 having profiled blades with a U-shaped portion 9. The U-shaped portions 9 of the blades together form an air-guiding channel.

As can be seen in FIGS. 1 and 2, the selvedge forming apparatus 6 includes a device 20 for introducing the end 30A of the weft thread 30 that has been inserted into a subsequent shed. This device 20 includes a holding nozzle 23 which for holding the end of a weft thread that has been introduced into the nip 31 of the holder 32 blows that end into a holding opening 24 of the holder 32. This device 20 includes a blowing element 21 provided with at least one blowing opening 22 for blowing a weft thread into a subsequent shed. In addition, the device also includes a plurality of blowing openings 25 and 26 which assist the jet of air from the at least one blowing opening 22. A compressed-air source 47 is connected via lines and valves 40, 41, 42 and 43 to the holding nozzle 23, the blowing openings 22, the blowing opening 25 and the blowing openings 26. The valves are controlled by a control unit (not shown). The abovementioned lines are partially formed by boreholes in the holder 32 and are designed analogously to PCT Pub. No.: WO 01/86047, in the name of the present Applicant. Obviously, the holder 32 may also be of identical design to that of WO 01/86047. The holder 32 is secured to a component 33 of the weaving machine using bolts 34.

Figure 3:
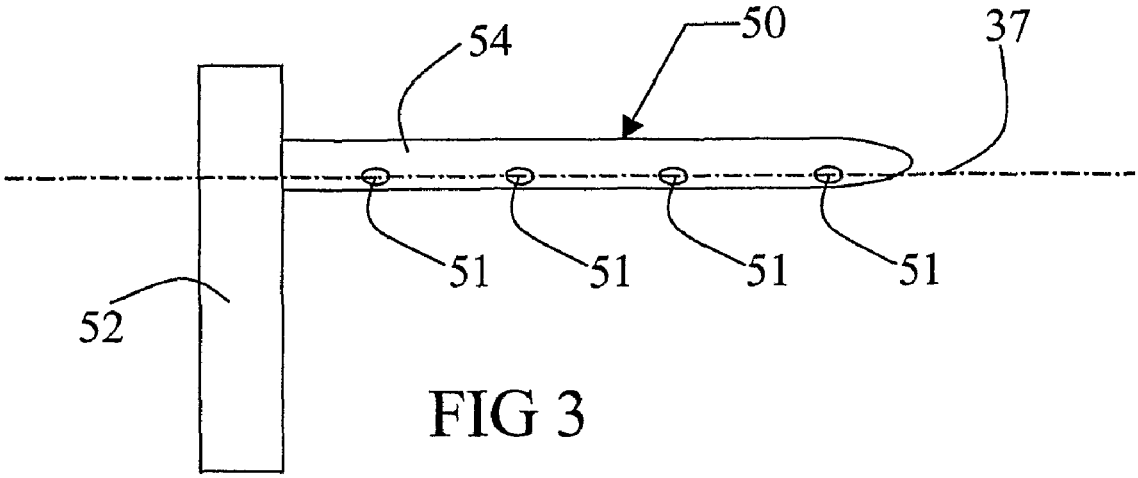
FIG. 3 shows a plan view of a part of FIG. 2.

According to the invention, the selvedge forming apparatus 6 as shown in FIGS. 2 and 3 also includes a blowing device 50 having at least one blowing opening 51 and being fixed to the weaving machine via a support 52. The support 52 is attached to the holder 32 of the selvedge forming apparatus 6. The at least one blowing opening 51 of the blowing device 50 is connected via a valve 55 to a compressed-air source 47. The blowing device 50 is positioned at about or near to the level of the plane of the woven fabric 3 in it's vicinity, more particularly in the vicinity of the plane of a selvedge 16 of the woven fabric 3. The blowing device 50 is also positioned in the vicinity of the beat-up line 36, i.e., the line to which the reed 7 moves and where the reed 7 beats-up the inserted weft. In operation blowing device 50, via the blowing openings 51, blows air jets essentially toward the beat-up line 36, and more particularly along a plane 48 which runs approximately parallel to the beat-up line 36 and is approximately directed toward the beat-up line 36. In this case, the blowing device 50 blows toward the rear side of the U-shaped portion 9 of the profiled blades of the reed 7. The beat-up line 36 in this case coincides with the position of the weft thread 30 that has just been beaten up, more particularly with the beat-up position of the reed 7 at the beating-up instant as shown in FIG. 2. At this instant, the weft thread 30 also forms fell line of the fabric. The blowing device 50 with it's blowing openings 51 is, at this instant, as shown in FIG. 2, located essentially in the U-shaped portion 9 of the profiled blades of the reed 7. The blowing device 50 is in this moment also located essentially under the weft thread 30 that has previously been beaten up, so that the blowing device 50, as illustrated in FIG. 2, scarcely blows onto this previous weft thread 30, but rather substantially blows only toward a weft thread 30 or an end 30A of a weft thread located at the beat-up line 36.

As can be seen from FIG. 3, the blowing openings 51 are positioned essentially along a line 37 which, in use, runs approximately parallel to the beat-up line 36. The blowing device 50 is positioned beneath the woven fabric 3 and in the vicinity of the beat-up line 36. The blowing device 50 includes a hollow needle 54, in which the blowing openings 51 are arranged, more particularly in which blowing openings 51 are arranged in one side of the hollow needle 54. In use, the hollow needle 54 is positioned approximately parallel to the beat-up line 36. In this case, the line 37 runs substantially axially with respect to the hollow needle 54, so that the blowing openings 51 open out along an axially oriented line 37 over the periphery of the hollow needle 54.

Figure 4:
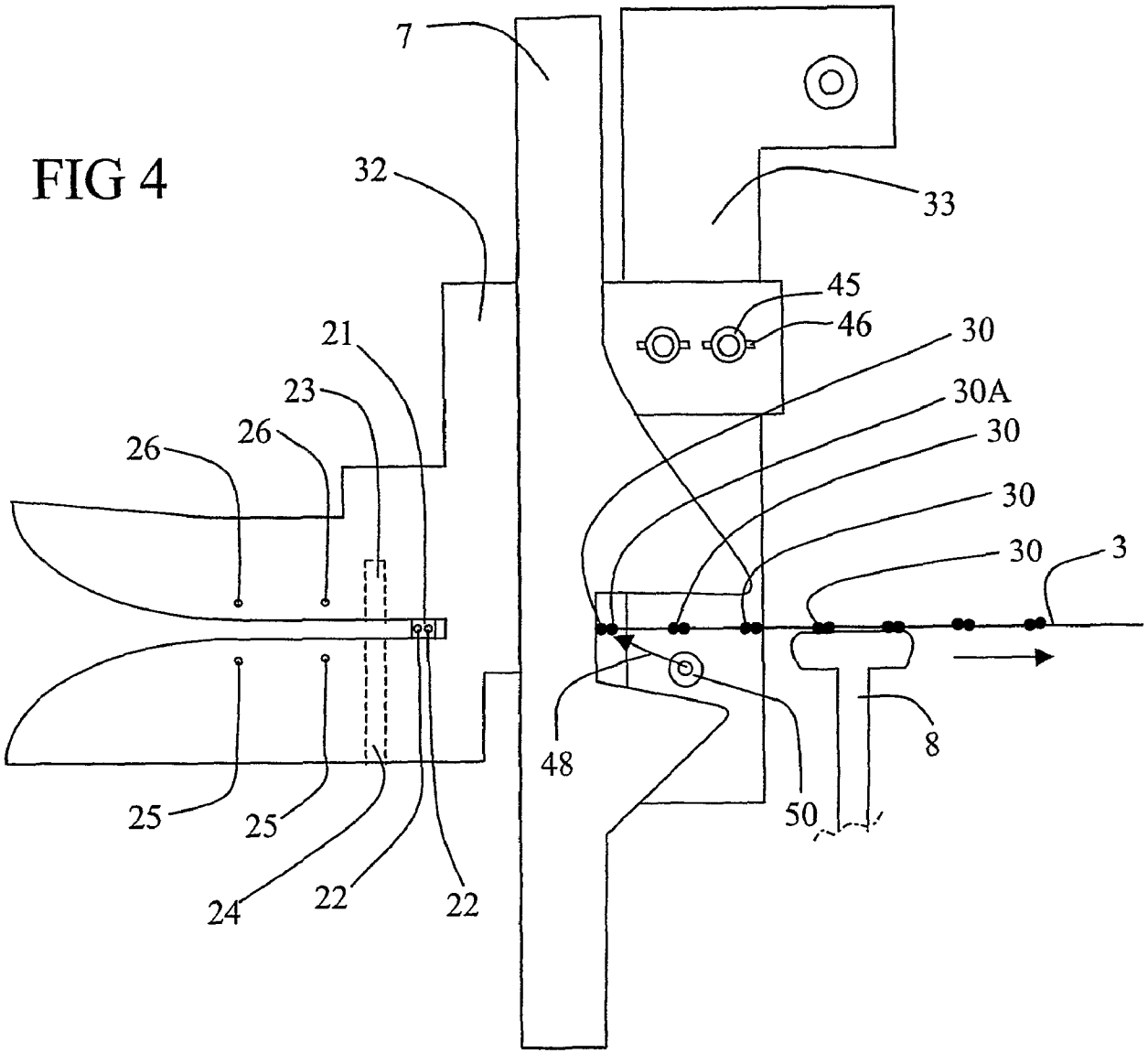
FIG. 4 shows a modification of FIG. 2.

FIG. 4 illustrates a modification in which the blowing device 50 is mounted on the component 33 of the weaving machine. This allows to adjust the holder 32 relatively to the component 33 without changing the position of the blowing device 50. In this case, the holder 32 may be adjusted by adjustment means 45 and 46 with respect to the component 33.

Figure 5:
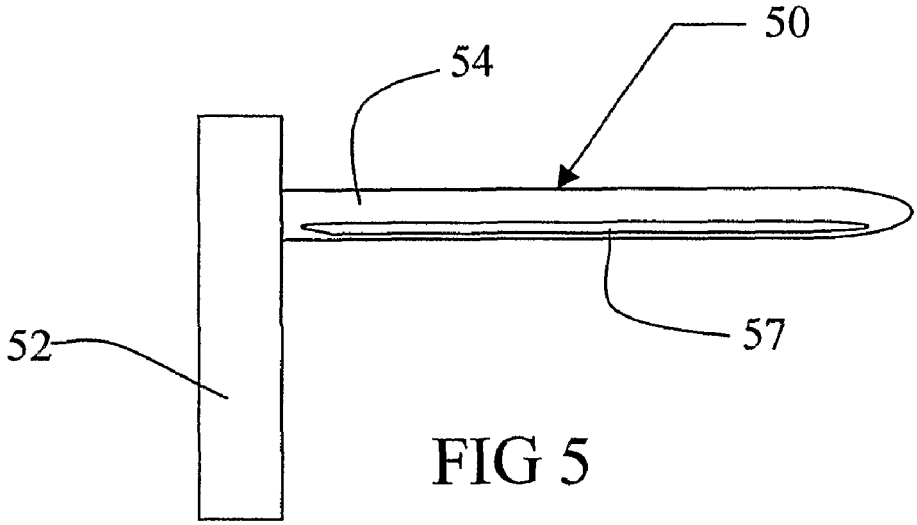
FIG. 5 shows a modification of FIG. 3.

FIG. 5 illustrates a modification in which the blowing device 50 is provided with an elongated blowing opening 57 which extends essentially axially along the longitudinal direction of the needle 50. This blowing opening 57 blows in this case in a plane 48 which is directed from the blowing opening 57 essentially toward the woven fabric 3 and essentially toward the beat-up line 36.

Figure 6:
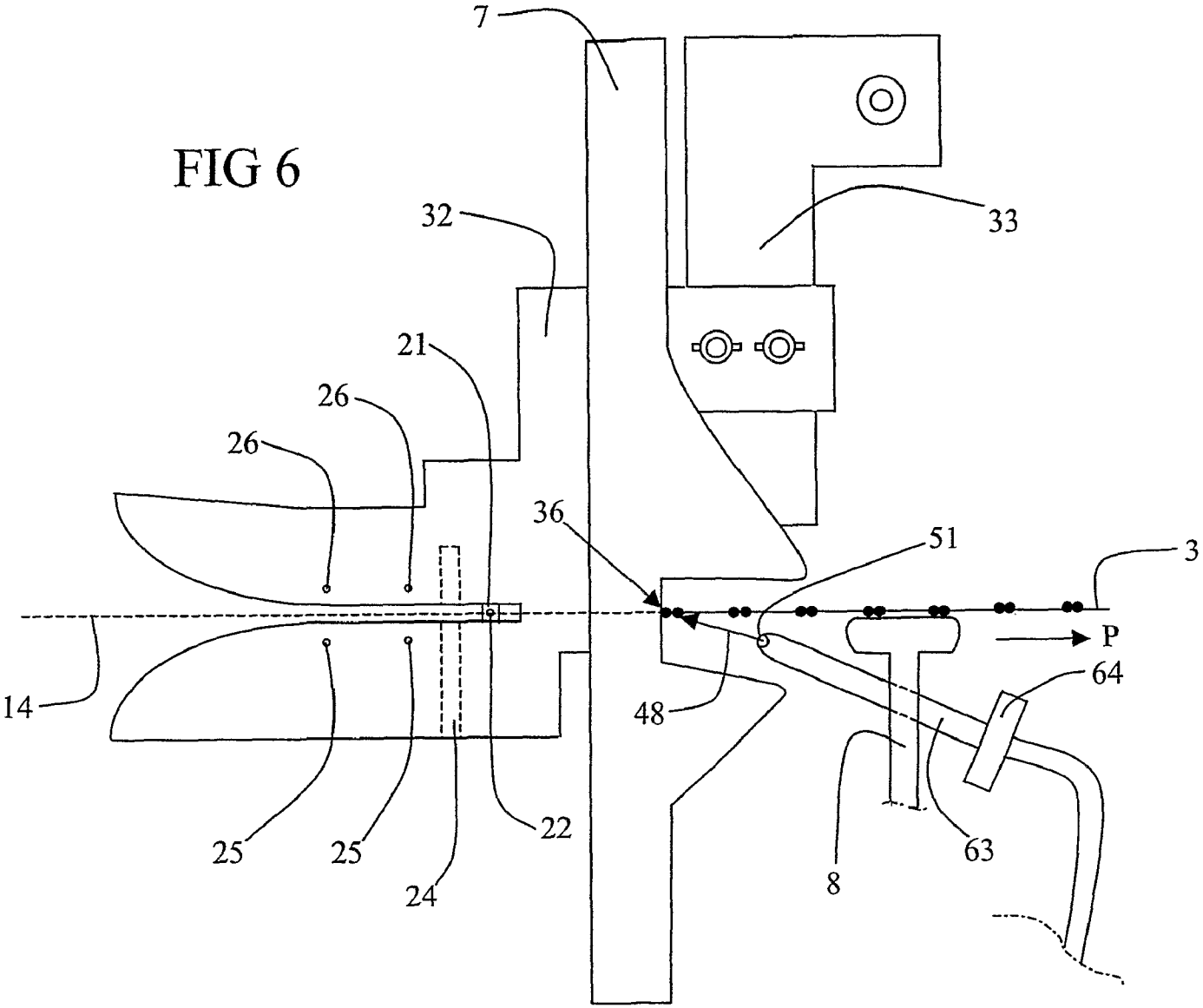
FIG. 6 shows another modification of FIG. 2.
Figure 7:
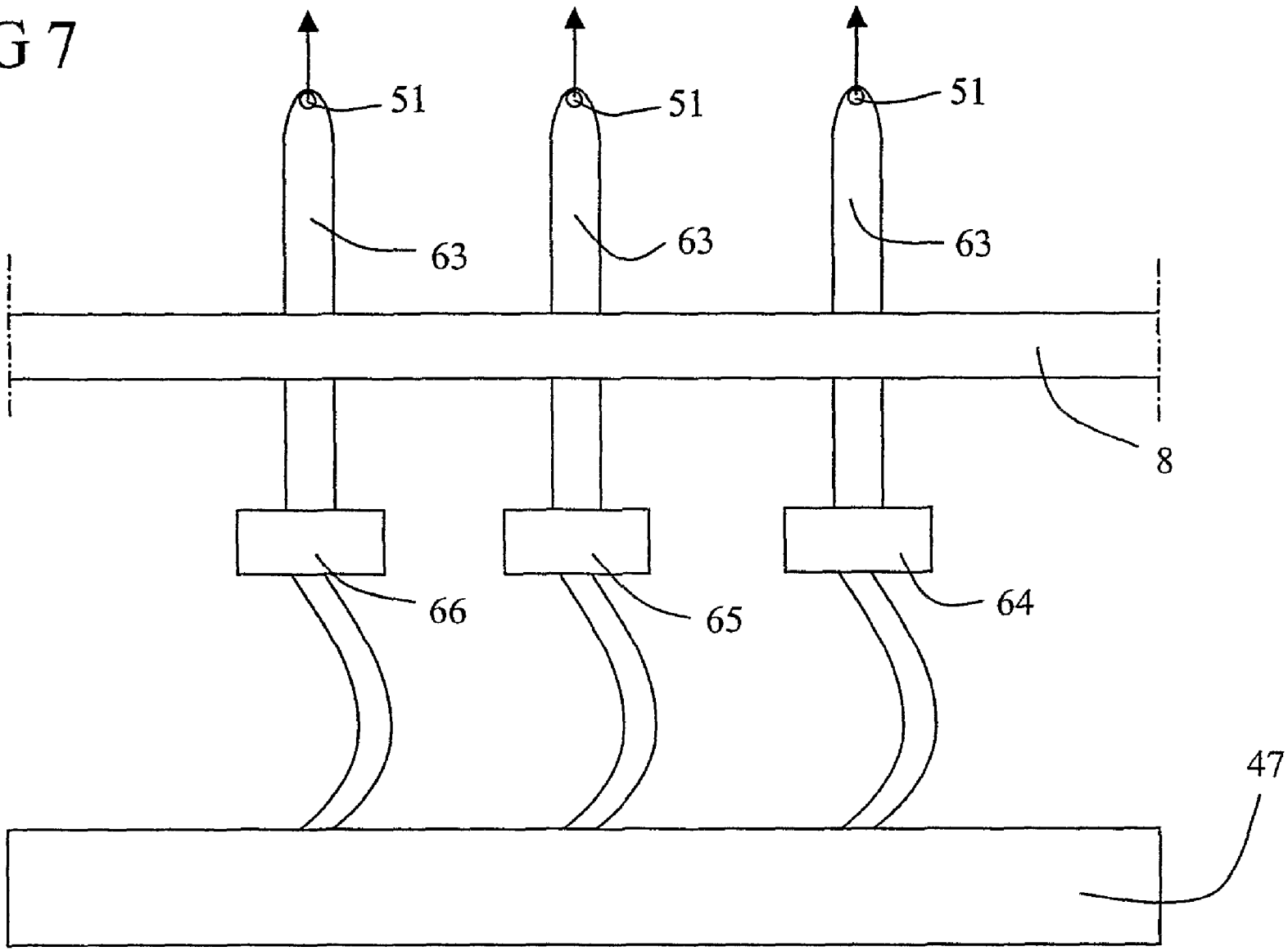
FIG. 7 shows a plan view of a part of FIG. 6.

FIGS. 6 and 7 illustrate a modification in which blowing openings 51 are each arranged separately on a hollow needle 63 which, in use, is directed perpendicularly to the beat-up line 36. In the example illustrated, these hollow needles 63 are secured to the fabric support 8. At their end, the hollow needles 63 have a blowing opening 51. Similarly to the illustration shown in FIG. 2, the blowing openings 51 can blow compressed air into a plane 48 which is directed toward the beat-up line 36. The position of the blowing openings 51 while a weft thread is being beaten up is essentially identical in FIGS. 2 and 6, and more particularly lies in the U-shaped portion 9 of the blades of the reed 7 and below the plane of the woven fabric 3. The blowing openings 51 of the various hollow needles 63 may, for example, each be provided with compressed air from a compressed-air source 47 via a separate valve 64, 65 or 66. This allows the instant of blowing from each blowing opening 51 to be controlled. According to a modification which is not shown, all the blowing openings 51, just as in the embodiment shown in FIG. 2, may be connected to a single valve, so that all the blowing openings 51 blow air at essentially the same instant. In this context, it should be noted that in the case of a hollow needle 54 having a plurality of blowing openings 51 as shown in FIG. 3, the blowing openings 51 do not all start to blow air at the same time, but rather the blowing opening 51 which is the first opening in the blowing direction will normally start to blow air first. The embodiment shown in FIGS. 6 and 7 having a plurality of valves 64 to 66 makes it possible to set which blowing opening 51 will start to blow first.

Figure 8:
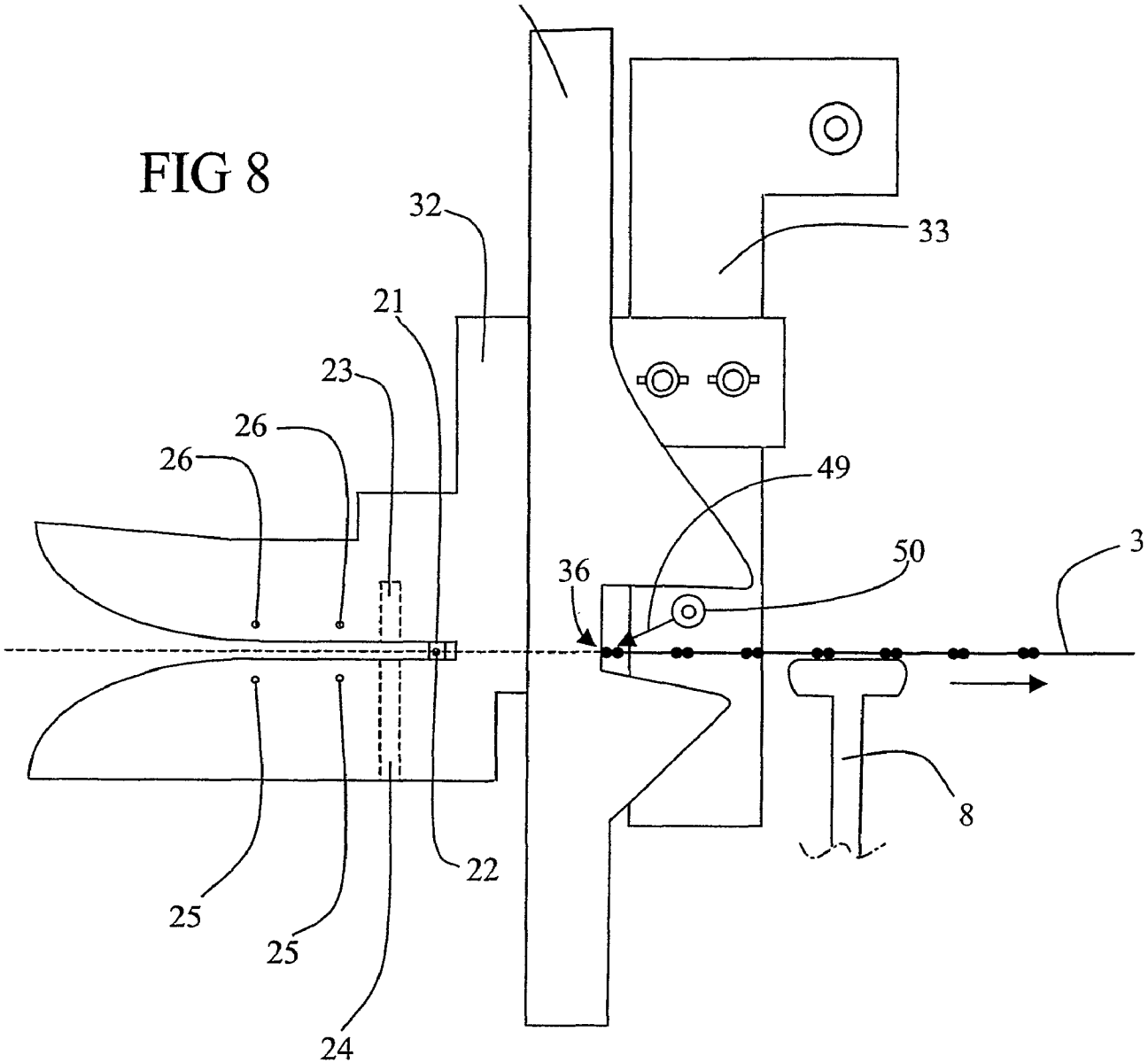
FIG. 8 shows another modification of FIG. 2.

FIG. 8 illustrates yet another modification, in which the blowing device 50 is positioned in the vicinity of the plane of the woven fabric 3 and blows along a plane 49 which is directed approximately toward the beat-up line 36 and runs approximately parallel to the beat-up line 36. In this case, the hollow needle 54 is positioned above the woven fabric 3 and in the vicinity of the beat-up line 36.

According to a modification which is not shown, it is possible to position a blowing device 50 similar to that shown in FIG. 2 beneath the woven fabric 3 and simultaneously a blowing device 50 as shown in FIG. 8 above the woven fabric 3. These two blowing devices 50 analogously allow one end of a weft thread to be blown into a desired position in the vicinity of the beat-up line 36.

Figures 9, 10, 11, 12:
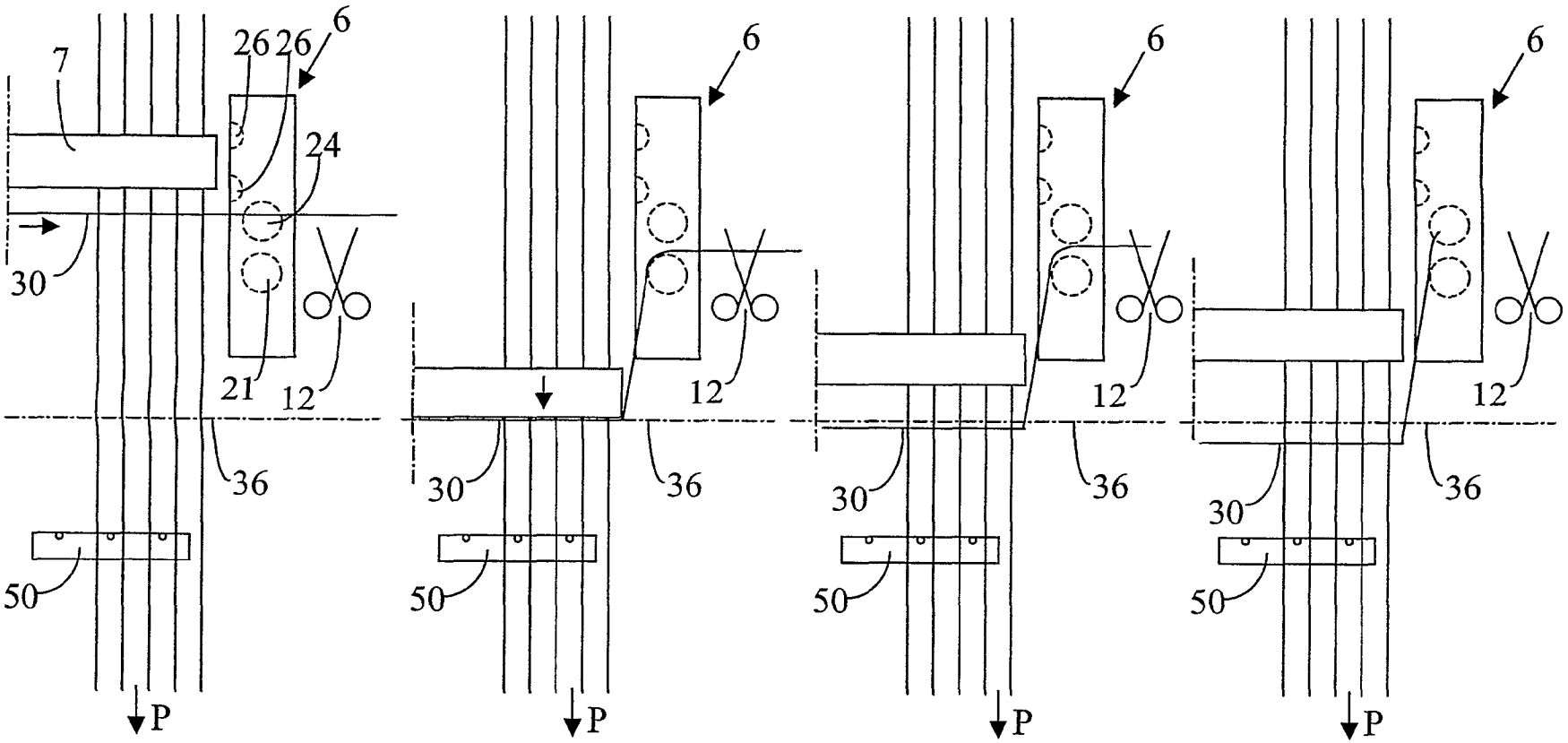
FIGS. 9 to 15 show a plan view of the function of the forming apparatus according to the invention in successive steps.
Figure 13:
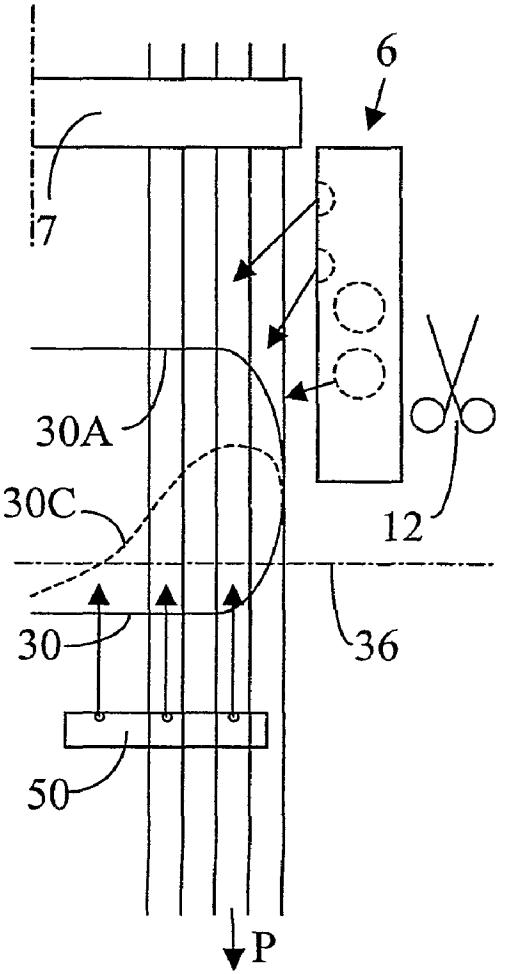
Figure 14:
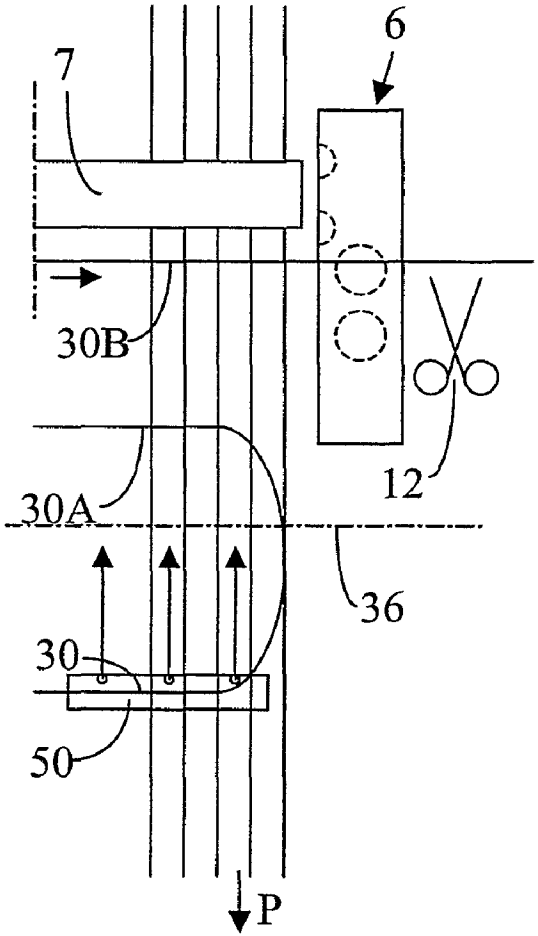
Figure 15:
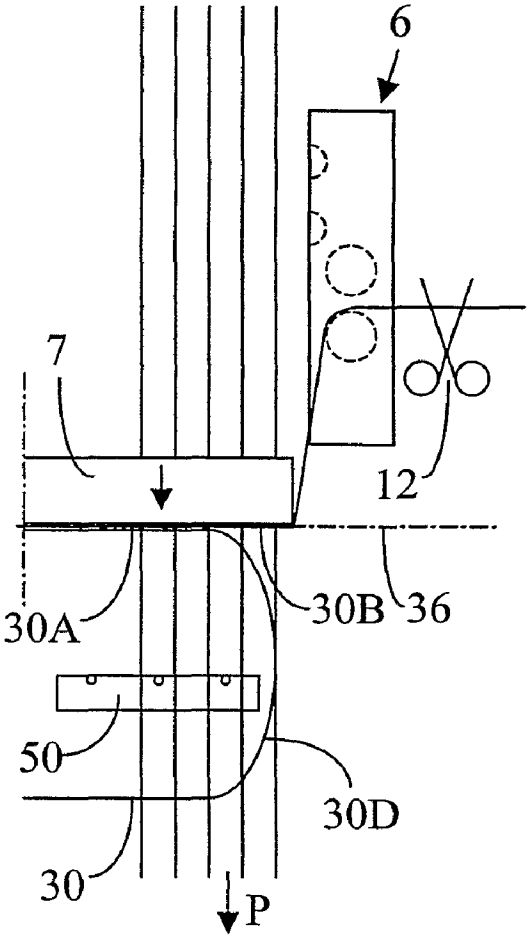

The operation of the device according to the invention will be explained with reference to FIGS. 9 to 15. After the weft thread 30 has been inserted, the end 30A of the weft thread 30 is received in the nip 31 of the holder 32 in a known way as shown in FIG. 9. Then, as shown in FIG. 10, this weft thread 30 is beaten up by the reed at 0° of the weaving machine (main shaft of weaving machine). As indicated in FIG. 11, the weft thread 30 is cut to length for example by the weft scissors 12 somewhere in the vicinity of 0° of the weaving machine. After the cutting operation, the end 30A of the weft thread 30 is blown by the holding nozzle 23 into the holding opening 24 of the holder 32, where it is held, as shown in FIG. 12. In the meantime, the woven fabric 3 moves onward in the direction indicated by arrow P, and the cut-off end 30A of the weft thread 30 is blown by blowing element 21, which is provided with at least one blowing opening 22, and the blowing openings 25 and 26 into a subsequent shed, as shown in FIG. 13. This blowing commences, for example, at approximately 150° and ends at approximately 320° or an angular position slightly before or after the subsequent shed closes. At the same time as the abovementioned blowing or shortly thereafter, the blowing device 50 is also activated and blows the introduced end of the weft thread essentially parallel to the weft thread 30 introduced previously, as shown in FIG. 14. According to one possible option, the blowing device 50 blows from 160° to 350° or just before the next weft thread is beaten up. In the meantime, a subsequent weft thread 30B is introduced in a similar way. The subsequent weft thread 30B is beaten up together with the abovementioned end 30A of the previous weft thread 30, resulting in the position shown in FIG. 15. As a result of an abovementioned blowing device 50 blowing onto an end 30A of a weft thread 30 which has been inserted into one shed and is being introduced into a subsequent shed, this end 30A, after it has formed a large loop 30D, is passed to essentially the level or height of the beat-up line 36 and therefore to the level or height of the subsequent weft thread 30B. This prevents the end 30A from adopting a position as indicated by dashed line 30C in FIG. 13.

Depending on the nature of the end 30A of a weft thread 30 that is to be inserted, the blowing device 50 blows slightly before, slightly after or at the instant at which this end 30A is blown into a subsequent shed by the blowing element 21 and the blowing openings 25 and 26. According to a modification which is not shown, the valves 40, 41, 42 and 43 can be replaced by a single valve which provides all these blowing openings with compressed air jointly. Notwithstanding the fact that it is preferable to provide a separate valve 55 for the blowing device 50, according to a modification which is not shown the function of said valve can be taken over by one of the valves 40, 41, 42 and 43. In this case, the valves 43 and 55 may, for example, be replaced by a single valve.

Obviously, the introduction of an end 30A into a subsequent shed does not have to be by blowing, but rather, according to a modification, may also be accomplished using known mechanical selvedge forming apparatuses, for example a selvedge tuck-in apparatus as is known from EP-A 322 014. It is important in the context of the present invention that this introduced end 30A can be blown by a device 50 according to the invention approximately parallel to the subsequently inserted weft thread, in order to be positioned in the vicinity of the beat-up line 36 and the weft thread 30B which is subsequently beaten up.

In the embodiment shown in FIG. 3, for example, the angular position of the blowing device 50 with respect to the support 52 can be adjusted, in such a manner that, in use, the blowing openings 51 of the hollow needle 54, which blow essentially in one plane 48, blow perfectly toward the beat-up line 36 or toward in front of the beat-up line 36 or blow toward behind the beat-up line 36. The correct position toward which the blowing openings of the blowing device 50 blow can be determined by testing. It has been determined that for most types of weft yarns it is better to blow to a location in front of the beat-up line 36, and for certain types of weft yarns it is better to blow to a location behind the beat-up line 36. It will be clear that in the example illustrated blowing is carried out toward the rear side of the U-shaped portion 9 of the profiled blades of the reed 7, and in this way always essentially toward the beat-up line 36 and into the shed.

Notwithstanding the fact that FIGS. 9 to 15 relate only to introduction of an end 30A of a weft thread 30 into a subsequent shed by means of the selvedge forming apparatus 6, it will be clear that the selvedge forming apparatuses 4 and 5 can also work in a similar way. In this case, the selvedge forming apparatus 5 is double-acting and can introduce each of two ends 30A into an associated shed. In this context, it will be clear that the blowing device 50 of the selvedge forming apparatus 4 is disposed in the vicinity of the plane of a selvedge 17 of the woven fabric 2. The two blowing devices 50 of the selvedge forming apparatus 5 are in this case respectively positioned in the vicinity of the plane of a selvedge 17 of the woven fabric 3 and in the vicinity of the plane of a selvedge 16 of the woven fabric 2.

It will be clear that all the valves 40, 41, 42, 43 and 55 are controlled in a known way by a control unit (not shown) of the air jet weaving machine, in accordance with a pattern which is a function of the weaving cycle or of the weft insertion pattern. It will also be clear that the selvedge forming apparatuses 4, 5 and 6, together with the weft scissors 10, 11, 12, can be arranged along a fabric support 8 of the weaving machine such that they can be displaced over the width of the weaving machine. The weft scissors 10, 11 and 12 can be secured in a known way to the respective selvedge forming apparatuses 4, 5 and 6, for example as shown in WO 01/86047.

According to the invention, it is not necessary to provide a holding nozzle 23 and a holding opening 24. According to yet another possible option, the holding opening 24 can also cooperate with means for sucking up an end of a weft thread instead of cooperating with a holding nozzle 23. According to another option, it is possible to provide a mechanical weft clamping device for this purpose. If no holding opening 24 or clamping device is provided, the end 30A of the weft thread that has been inserted may, for example, be held in what are known as catch threads or edge threads (not shown), which are disposed next to the woven fabric and along the end 30A beyond the holder 32. This means that the holder 32 is positioned between the woven fabric 3 and the catch threads. In this case, the end 30A is only cut through at the instant at which this end 30A is tucked or introduced into the subsequent shed. If 0° is the beat-up position, this cutting operation is carried out, for example, at 150°, which is approximately just before this end 30A is introduced into a subsequent shed.

The selvedge forming apparatus 4, 5, 6 according to the invention also offers the advantage of being easy to fit to an existing weaving machine. On account of the small dimensions of the blowing device 50, more particularly of the hollow needle 54 or of the hollow needles 63, they can easily be fitted to essentially any existing weaving machine, more particularly at the level of the U-shaped portion 9 of the blades of the reed 7.

Figure 16:
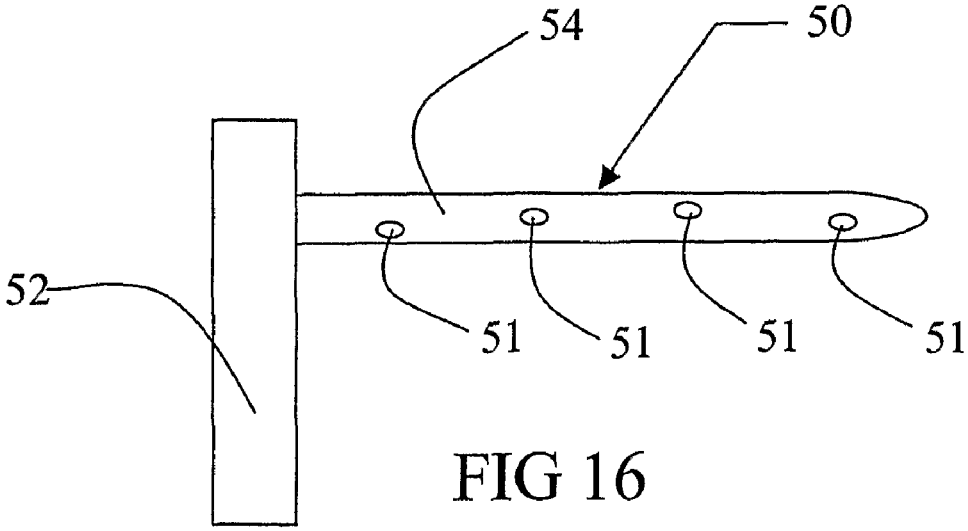
FIG. 16 shows a modification of FIG. 3.

FIG. 16 illustrates a modification in which the blowing openings 51 of the hollow needle 54 are not arranged in a line. In this case, the blowing openings 51 do not blow toward the beat-up line 36 in the same plane, but rather, by way of example, each individually blow toward the beat-up line 36. In this context, it is also possible, for example, for the hollow needle 54 not to be positioned perfectly parallel to the beat-up line 36, but rather, for example, to be positioned at a defined angle with respect to the beat-up line 36. Obviously, the blowing openings 51 do not have to blow toward the beat-up line along the warp direction, but rather may also blow along a blowing direction which forms a small angle with the warp direction and, for example, is directed slightly toward the center of the woven fabric.

Figure 19:
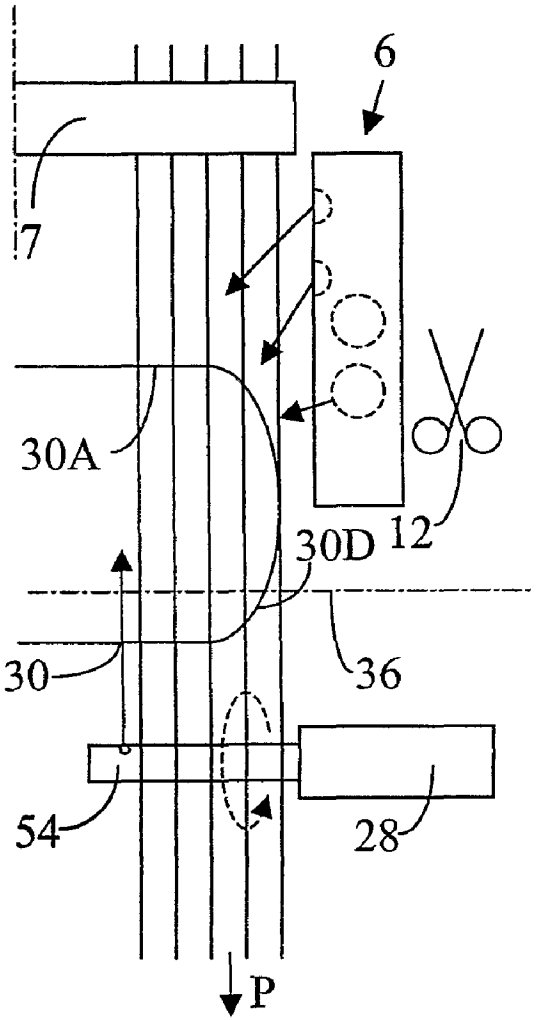
FIGS. 17 to 19 show an apparatus according to the invention in successive steps.
Figure 18:
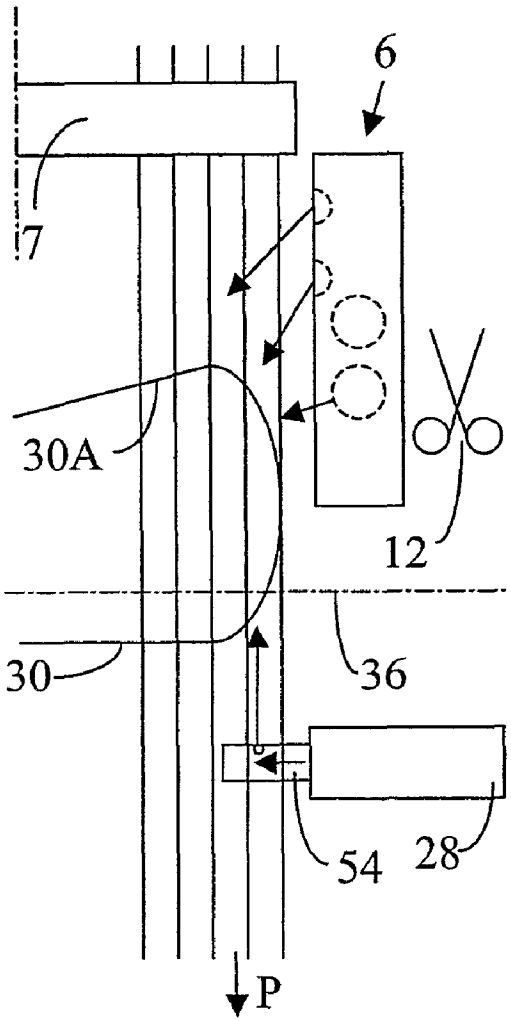
Figure 17:
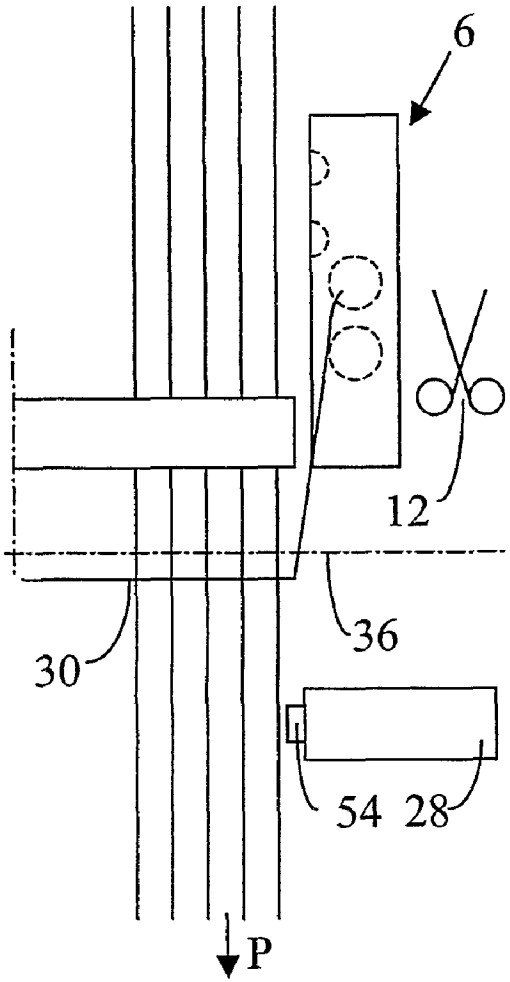

In the embodiment shown in FIGS. 17 to 19, the hollow needle 54 of the blowing device 50 is positioned displaceably. The blowing device 50 includes a drive unit 28 for displacing the hollow needle essentially along the weft direction. To introduce the end 30A of a weft thread into a subsequent shed, the hollow needle 54, as shown in FIG. 17, is located next to the woven fabric 3. While the end 30A of the weft thread 30 is being introduced into a subsequent shed, the hollow needle 54 is moved essentially along the weft direction in order to adopt a position at about the level of the plane of a selvedge 16 of the woven fabric 3 beneath the woven fabric 3. In this case, the blowing opening 51 of the hollow needle 54 blows onto the end 30A of the weft thread, resulting in the position shown in FIG. 18. Then, the hollow needle 54 moves, for example until the position shown in FIG. 19 is reached, while the blowing opening 51 continues to blow. This enables an end 30A of a weft thread 30 to be placed essentially perfectly parallel to the subsequent weft thread 30B and allows a large loop 30D to be obtained between the portion of the weft thread 30 in the previous shed and the end 30A of the weft thread 30 in the subsequent shed. It will be clear that the blowing device 50 as shown in FIGS. 17 to 19 is only positioned at about the level of the plane of a selvedge 16 of the woven fabric 3 for a certain time and only blows essentially toward the beat-up line 36 for a certain time.

Figure 20:
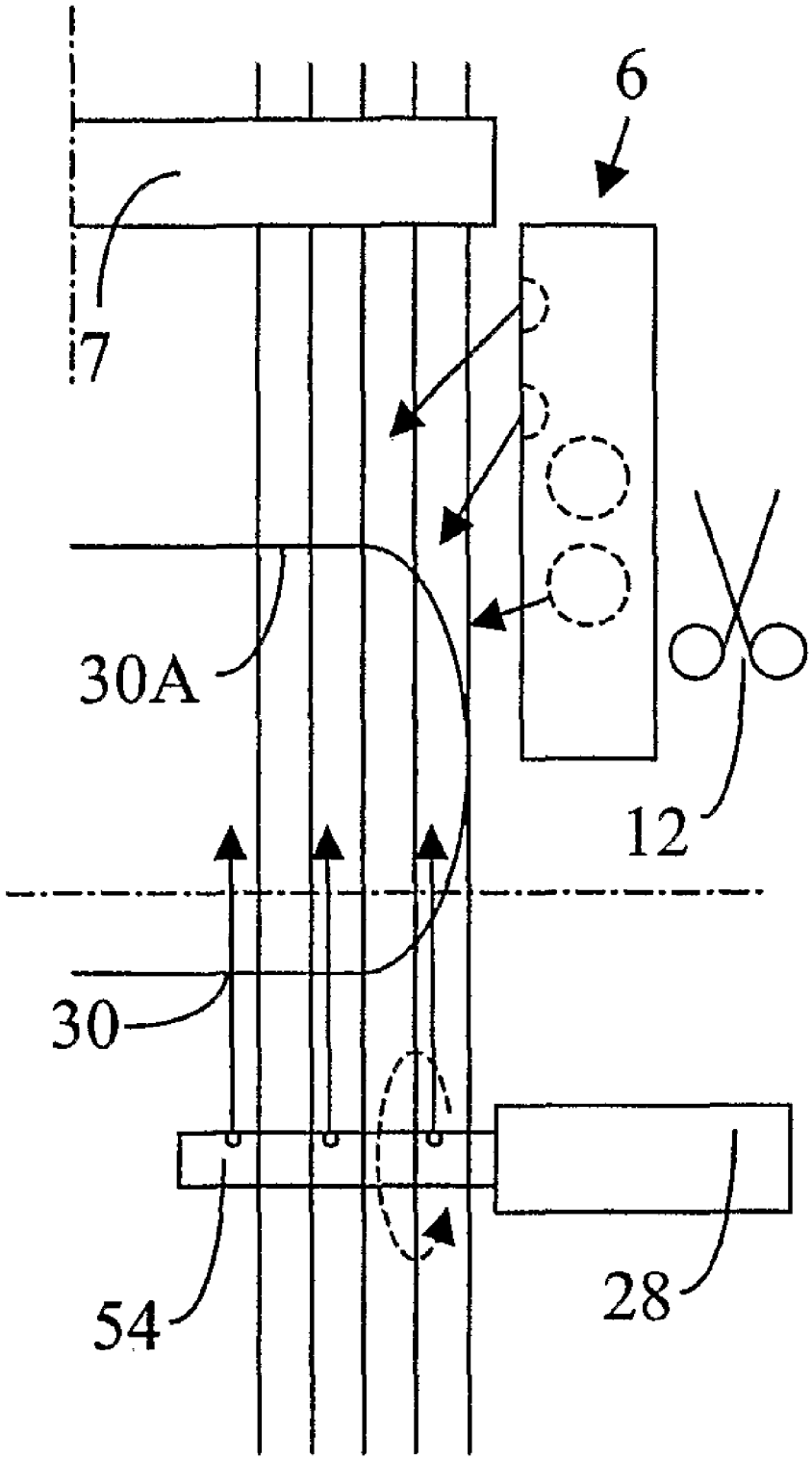
FIG. 20 shows a modification of FIG. 13.

In accordance with the embodiment shown in FIG. 20, the blowing device 50 is rotatably held and can be rotated by a drive unit 28. This can be realized, for example, by rotating the hollow needle 54 of the blowing device 50 about its axis of rotation. By way of example, this permits the blowing device 50 to blow toward the beat-up line 36 shortly before the subsequent weft thread 30B is beaten up. Rotation of the blowing device 50 such that the blowing device blows essentially toward the beat-up line 36 before a subsequent weft thread 30B is beaten up inter alia enables the end 30A of the weft thread 30 to form a large loop 30D while the end 30A is being woven into a subsequent shed. If the blowing device 50 shown in FIG. 20 can also move in the same way as the blowing device 50 shown in FIGS. 17 to 19, this rotation can take place, for example, while it is moving from the position shown in FIG. 18 toward the position shown in FIG. 19. From the position shown in FIG. 19, it is then possible to move back to the position shown in FIG. 17.

Figure 21:
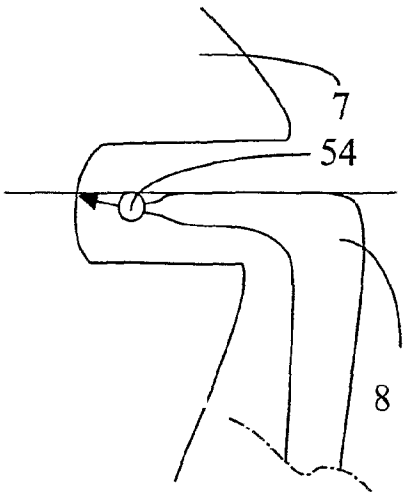
FIG. 21 shows another modification of FIG. 2.
Figure 22:
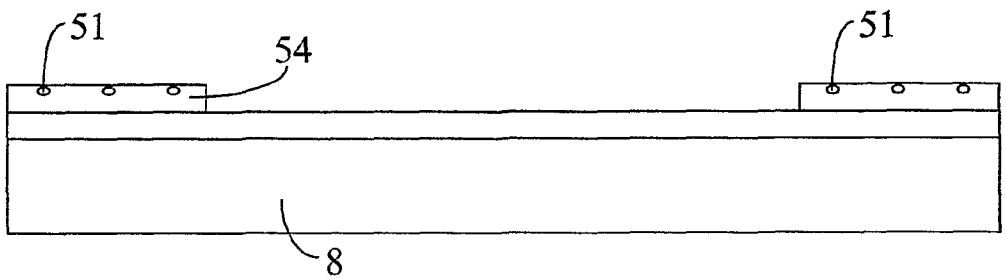
FIG. 22 shows a plan view of FIG. 21.

FIGS. 21 and 22 illustrate yet another modification, in which the blowing device 50 comprises a hollow needle 54 which is secured to the fabric support 8.

In this case, the hollow needle 54 serves not only to blow onto an end 30A of a weft thread 30 into a subsequent shed, but also to support the woven fabric 3 in the vicinity of the selvedges 16 and 17 by means of the top side of the needle 54.

Figure 23:
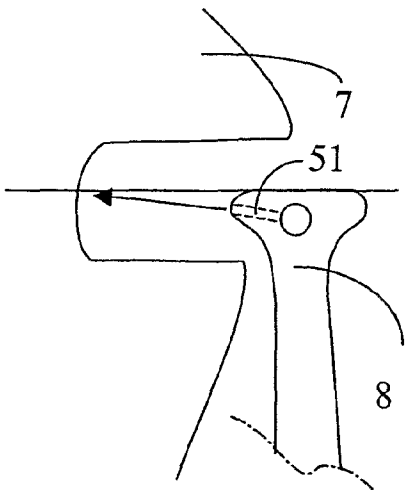
FIGS. 23 and 24 show a modification of FIGS. 21 and 22.
Figure 24:
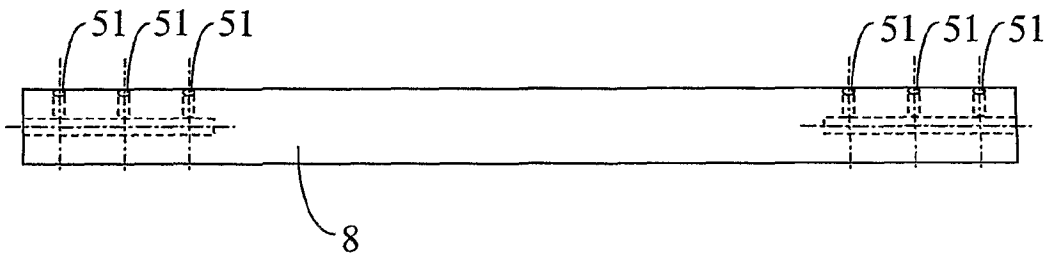

FIGS. 23 and 24 illustrate a modification in which the blowing device 50 is completely integrated in the fabric support 8. For this purpose, the fabric support includes drilled holes 29, which form blowing openings 51.

Figure 26:
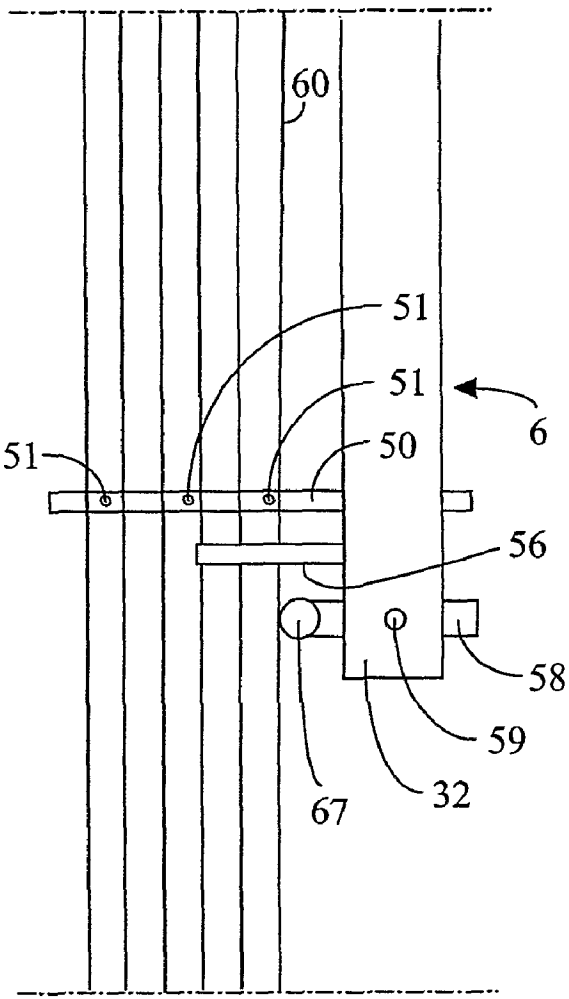
FIG. 26 shows a plan view of FIG. 25.
Figure 25:
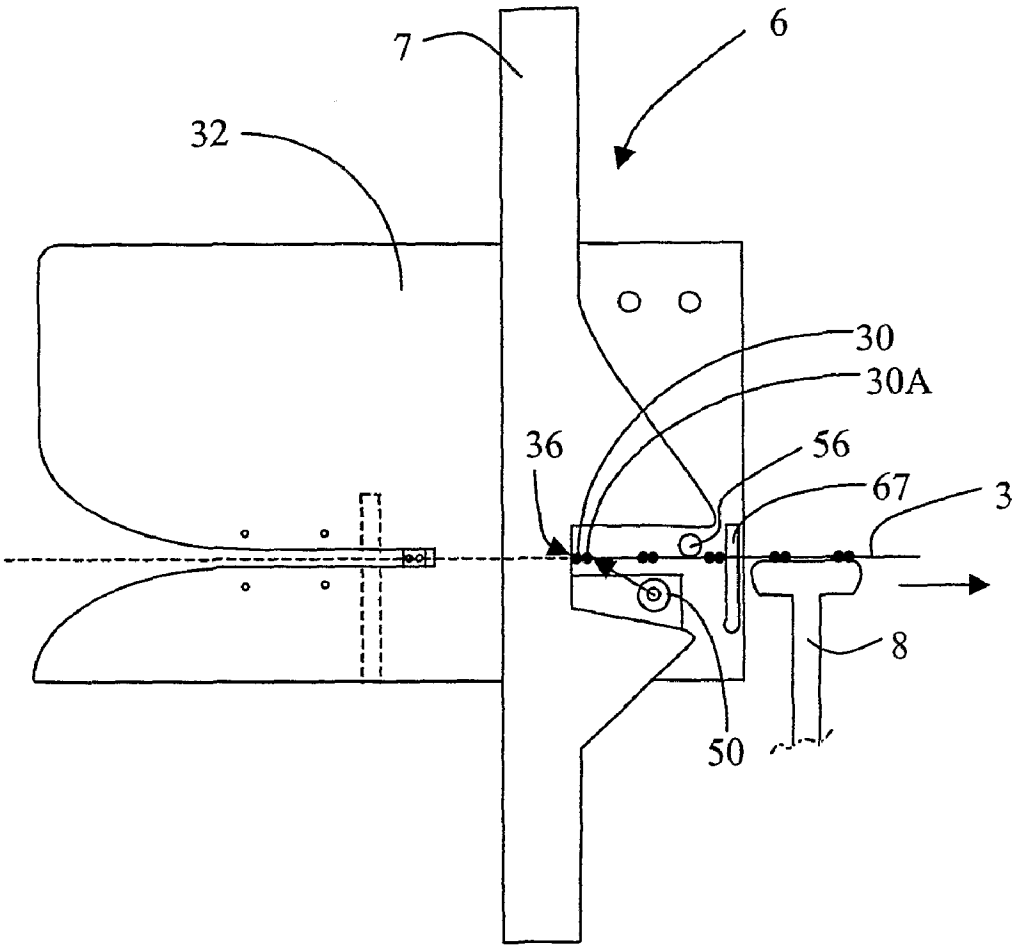
FIG. 25 shows a modification of part of FIG. 2.

In the embodiment shown in FIGS. 25 and 26, the selvedge forming apparatus 6 includes, in addition to the blowing device 50, a guide bar 56, which is located on the other side of the warp threads and/or the woven fabric 3 with respect to the blowing device 50. In this case, these warp threads and/or the edge of the woven fabric 3 are located between the hollow needle of the blowing device 50 and the guide bar 56. This guide bar 56 is used to force the warp threads and/or the woven fabric 3 into a defined position with respect to the blowing device 50, so that the blowing device 50 is positioned in essentially the same position with respect to the beat-up line 36 essentially irrespective of the binding pattern of the warp threads. This selvedge forming apparatus 6 may also include a guide bar 67 which cooperates with the edge of the woven fabric 3 and/or with the warp threads 60 which are positioned in the vicinity of this edge. This enables the above-mentioned edge to be placed in a well-defined position with respect to the blowing device 50. The provision of the guide bars 56 and 67 is advantageous for introducing the end of the inserted weft thread into a subsequent shed. In the embodiment illustrated, the guide bar 67 is provided on a mandrel 58 which can be secured in a defined axial position in the holder 32 by means of a securing screw 59. This makes it possible to adjust the position of the guide bar 67 with respect to the warp threads 60 and/or the edge of the woven fabric and/or the blowing openings 51 of the blowing device 50. The guide bar 67 and/or the guide bar 56 may, for example, comprise a wear-resistant outer cover according to one embodiment.

Figure 27:
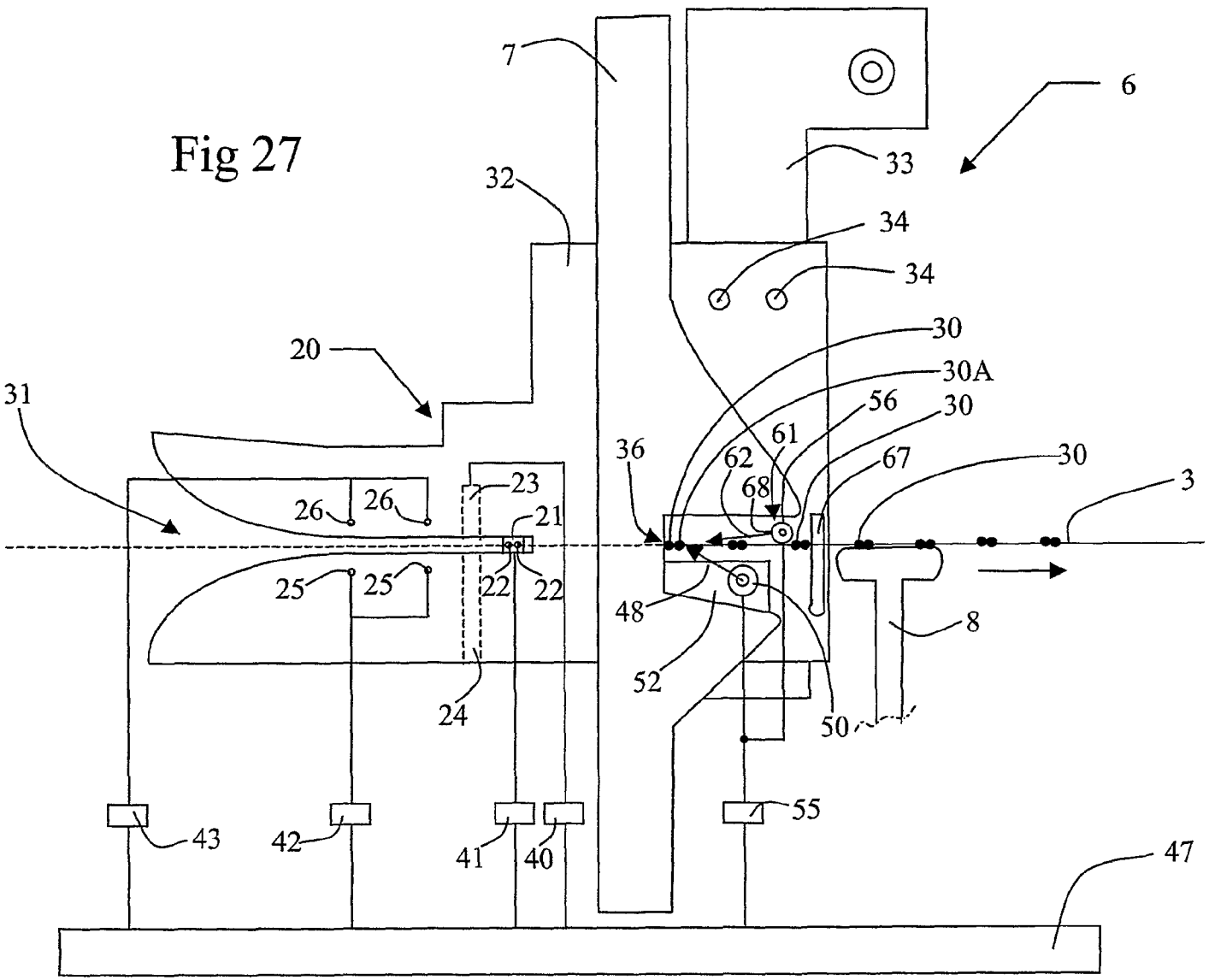
FIG. 27 shows a modification of FIG. 2.

In the embodiment shown in FIG. 27, the guide bar 67 is also designed as a blowing device 61 and, like the blowing device 50, by way of example includes at least one blowing opening 68 which, in operation, permits blowing essentially toward the beat-up line 36, more particularly along a plane 62. In this case, the guide bar 67 is designed, for example, like the blowing device 50, as a hollow metal needle which is provided with at least. one blowing opening 68 in the side. The blowing device 61 is connected, for example via a valve 55, to a compressed-air source 47 and in this way blows essentially together with the blowing device 50.

Notwithstanding the fact that in FIGS. 25 to 27 the guide bar 67 is positioned further from the beat-up line 36 than the blowing device 50, it will be clear that this guide bar 67 may be positioned at the same distance from the beat-up line 36 as the blowing device 50 or even closer to the beat-up line 36. It will be clear that the blowing device 50, which is designed as a hollow needle, will likewise perform the function of the guide bar 67, and more particularly this hollow needle of the blowing device 50, together with the guide bar 67, can adopt responsibility for guiding the woven fabric and/or the warp threads 60 in the vicinity of the edge. In the embodiment shown in FIG. 26, the guide bar 67 Is shorter than the hollow needle of the blowing device 50. According to a modification which is not shown, the guide bar 67 may be selected to be of the same length or even longer, notwithstanding the fact that good results are obtained using the shorter guide bar 67.

The device according to the invention is advantageous in particular if it is used for woven fabrics in which the weft threads are woven in at a relatively great distance from one another. In this case, it is important for the blowing device 50 to blow essentially toward the beat-up line 36. If weft threads are woven in at a relatively great distance from one another, it will be clear that the beat-up line 36, which is determined by the end position of the reed 7, and the fell line or the shed edge of the woven fabric, which is formed by the last weft thread 30 inserted just before a subsequent weft thread 30B is beaten up, will be located at a relatively great distance from one another.

It will be clear that the invention is not restricted to air weaving machines, but rather may also be applied to other weaving machines, such as gripper weaving machines, multiphase weaving machines, such as, inter alia, weaving rotors, gripper band weaving machines, water jet weaving machines, projectile weaving machines and other weaving machines and looms.

The selvedge forming apparatus, the weaving machine and the method according to the invention are obviously not restricted to the embodiments which have been described by way of example and illustrated in the figures, but rather can be designed in accordance with a number of modifications and/or combinations of the embodiments illustrated within the scope of the present invention.

The invention claimed is:

1. Selvedge forming apparatus for a weaving machine having a beat-up reed movable to and fro to advance each inserted weft thread up to a beat-up line and a selvedge forming device locatable adjacent a selvedge of a fabric being woven on such a weaving machine configured to introduce an end of each weft thread that has been inserted during weaving via a shed into a subsequently formed shed of such weaving machine for being beat-up with the subsequently inserted weft thread, said selvedge forming apparatus comprising:

a blowing device having at least one blowing opening adapted to be located close to and downstream of the beat-up line of such weaving machine relative to fabric movement close to a plane of the selvedge with an orientation enabling blowing of an air stream onto the end of the weft thread that has been introduced into the subsequently formed shed but before being beat-up, said orientation resulting in blowing of air in a direction back towards the shed and the reed and opposite to the direction of movement of the fabric being woven, so that the end of the weft thread that has been introduced into the subsequently formed shed is blown towards the subsequently inserted weft thread before beat-up in a direction opposite to the direction of fabric movement.

2. Selvedge forming apparatus according to claim 1, wherein the blowing opening is oriented such that an air stream may be directed to the end of the weft thread that has been introduced into the subsequently formed shed from a location that is above or beneath a fabric being woven.

3. Selvedge forming apparatus according to claim 1, wherein the blowing opening comprises an elongate linear slot, and wherein the slot is locatable so that it extends essentially parallel to the beat-up line.

4. Selvedge forming apparatus according to claim 1, wherein the at least one blowing opening comprises several blowing openings arranged along a single line, and wherein the line of openings is locatable so that it extends essentially parallel to the beat-up line.

5. Selvedge forming apparatus according to claim 1, wherein the blowing device comprises a hollow needle, and wherein the at least one blowing opening is arranged in a side of the hollow needle, said needle being positionable so it extends essentially parallel to the beat-up line.

6. Selvedge forming apparatus according to claim 1, wherein the position of the blowing device is adjustable such that its distance to the beat-up line and/or its blowing direction may be adjusted.

7. Selvedge forming apparatus according to claim 1, including one or more drive units arranged to move the position of the blowing device along a beat-up line or alter the direction of the blowing opening.

8. Selvedge forming apparatus according to claim 1, including a guide bar configured and locatable so as to guide the upper side and/or the under side of a selvedge of a fabric being woven after the beat-up line relative to the blowing device, the guiding element being locatable on the opposite side of the fabric being woven than the side on which the blowing device is located.

9. Selvedge forming apparatus according to claim 1, including a side guiding element arranged to enable the edge of the selvedge of a fabric being woven following the beat-up line to be guided relative to the blowing device.

10. Weaving machine comprising a beat-up reed movable to and fro to advance each inserted weft thread up to a beat-up line and a selvedge forming device located adjacent a selvedge of a fabric being woven on the weaving machine configured to introduce an end of each weft thread that has been inserted during weaving via a shed into a subsequently formed shed of the weaving machine for being beat-up with the subsequently inserted weft thread;

said selvedge forming apparatus comprising a blowing device having at least one blowing opening located close to and downstream of the beat-up line relative to fabric movement close to a plane of the selvedge with an orientation enabling blowing of an air stream onto the end of the weft thread that has been introduced into the subsequently formed shed but before being beat-up, said orientation resulting in blowing of air in a direction back towards the shed and the reed and opposite to the direction of movement of the fabric being woven, so that the end of the weft thread that has been introduced into the subsequently formed shed is blown towards the subsequently inserted weft thread before beat-up in a direction opposite to the direction of fabric movement.

11. Weaving machine according to claim 10, wherein the blowing opening is oriented such that an air stream is directed to the end of the weft thread that has been introduced into the subsequently formed shed from a location that is above or beneath the fabric being woven.

12. Weaving machine according to claim 10, wherein the blowing opening comprises an elongate linear slot, and wherein the slot is locatable so that it extends essentially parallel to the beat-up line.

13. Weaving machine according to claim 10, wherein the at least one blowing opening comprises several blowing openings arranged along a single line, and wherein the line of openings is located so that it extends essentially parallel to the beat-up line.

14. Weaving machine according to claim 10, wherein the blowing device comprises a hollow needle, and wherein the at least one blowing opening is arranged in a side of the hollow needle, said needle being located so it extends essentially parallel to the beat-up line.

15. Weaving machine according to claim 10, wherein the position of the blowing device is adjustable such that its distance to the beat-up line and/or its blowing direction may be varied.

16. Weaving machine according to claim 10, including one or more drive units arranged to move the position of the blowing device along a beat-up line or alter the direction of the blowing opening.

17. Weaving machine according to claim 10, including a guide bar configured and located so as to guide the upper side and/or the under side of a selvedge of a fabric being woven after the beat-up line relative to the blowing device, the guiding element being located on the opposite side of a fabric being woven than the side on which the blowing device is located.

18. Weaving machine according to claim 16, wherein the guide bar comprises a blowing device having at least one blowing opening directed towards the beat-up line.

19. Weaving machine according to claim 10, including a side guiding element arranged to guide the edge of the selvedge of a fabric being woven following the beat-up line relative to the blowing device.

20. Weaving machine according to claim 10, including a fabric support following the beat-up line, said blowing device being attached to the fabric support.

21. Method for forming a selvedge on a fabric during weaving on a weaving machine, comprising the steps of:

inserting a weft thread into a shed formed of warp threads and beating-up the inserted weft thread by a device moving to a beat-up line;

introducing an end of the inserted weft thread into a subsequently formed shed;

inserting a next weft thread into the subsequently formed shed, and beating-up said next weft thread together with the end of the previously inserted weft thread at the beat-up line;

wherein, before beating up the end of the weft thread that has been introduced into the subsequently formed shed, an air-stream is blown onto said end of the weft thread before beat-up, said air-stream being essentially directed towards the beat-up line against the moving direction of the fabric being woven so as to urge the weft thread that has been introduced into the subsequently formed shed towards the next weft thread.

22. Method according to claim 21, wherein during the blowing of the air stream, the air-stream is directed from below or above the plane of the fabric.

23. Method according to claim 21, wherein during blowing of the air stream, blowing the air-stream so as to blow the end of the next weft thread introduced into the subsequently formed shed into a guide channel of a reed which is moving toward the beat-up line.

24. Method according to claim 21, including carrying out the insertion of the end of the next weft thread into the subsequently formed shed by blowing that end into that subsequent shed.

* * * * *